US011094285B2

(12) United States Patent
Huang et al.

(10) Patent No.: US 11,094,285 B2
(45) Date of Patent: Aug. 17, 2021

(54) DRIVING CHIP, METHOD FOR CONTROLLING THE SAME, AND DISPLAY DEVICE

(71) Applicant: WuHan TianMa Micro-electronics CO., LTD, Wuhan (CN)

(72) Inventors: Yang Huang, Wuhan (CN); Jun Li, Wuhan (CN); Zhihua Yu, Wuhan (CN)

(73) Assignee: WuHan TianMa Micro-electronics CO., LTD, Wuhan (CN)

( * ) Notice: Subject to any disclaimer, the term of this patent is extended or adjusted under 35 U.S.C. 154(b) by 0 days.

(21) Appl. No.: 16/675,036

(22) Filed: Nov. 5, 2019

(65) Prior Publication Data

US 2021/0005158 A1 Jan. 7, 2021

(30) Foreign Application Priority Data

Jul. 1, 2019 (CN) ..... 201910585608.8

(51) Int. Cl.
*G09G 5/02* (2006.01)
*G09G 3/3258* (2016.01)
(Continued)

(52) U.S. Cl.
CPC ..... *G09G 5/02* (2013.01); *G09G 3/3258* (2013.01); *G09G 3/3266* (2013.01); *G09G 5/10* (2013.01);
(Continued)

(58) Field of Classification Search
CPC ..... G09G 5/02; G09G 3/3258; G09G 3/3266; G09G 5/10; G09G 2320/0633; G09G 2320/0666
See application file for complete search history.

(56) References Cited

U.S. PATENT DOCUMENTS

2008/0252794 A1* 10/2008 Su ..... H04N 21/44008 348/739
2013/0147861 A1* 6/2013 Kim ..... G09G 5/10 345/690
2013/0169693 A1* 7/2013 Pyo ..... G09G 3/3225 345/690

FOREIGN PATENT DOCUMENTS

CN 104732949 A 6/2015
CN 106782277 A 5/2017

OTHER PUBLICATIONS

First Office Action dated May 25, 2020, issued in Chinese Application No. 201910585608.8, filed Jul. 1, 2019, 29 pages.

* cited by examiner

*Primary Examiner* — Charles V Hicks
(74) *Attorney, Agent, or Firm* — Christensen O'Connor Johnson Kindness PLLC

(57) ABSTRACT

A driving chip, a control method therefor and a display device are provided. The driving chip includes Gamma voltage generating circuits, first power supply voltage output circuits and a color cast adjustment circuit. The Gamma voltage generating circuits correspond to sub-pixels of different colors. The first power supply voltage output circuits are electrically connected to different Gamma voltage generating circuits and each of the first power supply voltage output circuits is configured to output a first power supply voltage to a corresponding first power supply voltage terminal. The color cast adjustment circuit is electrically connected to each first power supply voltage output circuit, and is configured to adjust the first power supply voltage output by at least one first power supply voltage output circuits according to a light-emitting duration of a light-emitting device in a display panel per unit time.

17 Claims, 4 Drawing Sheets

(51) Int. Cl.
*G09G 3/3266* (2016.01)
*G09G 5/10* (2006.01)

(52) U.S. Cl.
CPC ..... *G09G 2320/0633* (2013.01); *G09G 2320/0666* (2013.01)

DRIVING CHIP, METHOD FOR CONTROLLING THE SAME, AND DISPLAY DEVICE

CROSS-REFERENCE TO RELATED APPLICATIONS

The present application claims priority to Chinese Patent Application No. 201910585608.8, filed on Jul. 1, 2019, the content of which is incorporated herein by reference in its entirety.

TECHNICAL FIELD

The present disclosure relates to the field of display technologies, and more particularly, to a driving chip, a method for controlling the driving chip, and a display device.

BACKGROUND

During a driving process, an organic light-emitting display panel is driven by a voltage generated by a Gamma voltage generating circuit to emit light in order to display images. The display panel includes pixels, and each pixel is composed of sub-pixels of three colors of red, green and blue. By setting a bright-dark ratio of the sub-pixels, corresponding colors are formed, and finally a complete image displays. The Gamma voltage generating circuit generates a Gamma voltage based on an original image signal, and the Gamma voltage is transmitted to each sub-pixel of the organic light-emitting display panel so as to drive a light-emitting device of the sub-pixel to emit a light, and light-emitting brightness of the light-emitting device is determined by the Gamma voltage.

One method to adjust overall brightness of the image is to change a light-emitting time of the light-emitting device. For example, when the light-emitting time per unit time of each light-emitting device is reduced, brightness of the organic light-emitting display panel will be lowered, so as to adjust the brightness of the organic light-emitting display panel. However, when the brightness is relatively low, a color cast of the image easily occurs.

SUMMARY

Embodiment of the present disclosure provide a driving chip, a method for controlling the driving chip and a display device, which can adjust power supply voltages corresponding to Gamma voltage generating circuits corresponding to sub-pixels of different colors according to a light-emitting time of a light-emitting device, thereby improving color cast of an image.

In one aspect, embodiments of the present disclosure provide a driving chip applied in a display panel, and the driving chip includes:

Gamma voltage generating circuits, where the Gamma voltage generating circuits correspond to sub-pixels of different colors, and each of the Gamma voltage generating circuits includes a first power supply voltage terminal and a second power supply voltage terminal that are separate, and a resistor connected in series between the first power supply voltage terminal and the second power supply voltage terminal;

first power supply voltage output circuits electrically connected to different Gamma voltage generating circuits, and each of the first power supply voltage output circuits being configured to output a first power supply voltage to the first power supply voltage terminal of a corresponding one of the Gamma voltage generating circuits; and a color cast adjustment circuit, where the color cast adjustment circuit is electrically connected to each of the first power supply voltage output circuits, and the color cast adjustment circuit is configured to adjust the first power supply voltage output by at least one of the first power supply voltage output circuits according to a light-emitting duration of a light-emitting device in the display panel per unit time.

In another aspect, an embodiment of the present disclosure further provides a display device including a display panel and a driving chip applied in the display panel, the driving chip includes:

Gamma voltage generating circuits, where the Gamma voltage generating circuits correspond to sub-pixels of different colors, and each of the Gamma voltage generating circuits includes a first power supply voltage terminal and a second power supply voltage terminal that are separate, and a resistor connected in series between the first power supply voltage terminal and the second power supply voltage terminal;

first power supply voltage output circuits electrically connected to different Gamma voltage generating circuits, each of the first power supply voltage output circuits being configured to output a first power supply voltage to the first power supply voltage terminal of a corresponding one of the Gamma voltage generating circuits; and a color cast adjustment circuit, where the color cast adjustment circuit is electrically connected to each of the first power supply voltage output circuits, and the color cast adjustment circuit is configured to adjust the first power supply voltage output by at least one of the first power supply voltage output circuits according to a light-emitting duration of a light-emitting device in the display panel per unit time.

In another aspect, an embodiment of the present disclosure further provides a method for controlling a driving chip, the driving chip includes:

Gamma voltage generating circuits, where the Gamma voltage generating circuits correspond to sub-pixels of different colors, and each of the Gamma voltage generating circuits includes a first power supply voltage terminal and a second power supply voltage terminal that are separate, and a resistor connected in series between the first power supply voltage terminal and the second power supply voltage terminal; and first power supply voltage output circuits electrically connected to different Gamma voltage generating circuits, each of the first power supply voltage output circuits being configured to output a first power supply voltage to the first power supply voltage terminal of a corresponding one of the Gamma voltage generating circuits; and the method for controlling the driving chip includes:

adjusting the first power supply voltage output by at least one of the first power supply voltage output circuits according to a light-emitting duration of a light-emitting device in a display panel per unit time.

BRIEF DESCRIPTION OF DRAWINGS

In order to more clearly describe technical solutions of embodiments of the present disclosure, the accompanying drawings in the embodiments are briefly described below. The drawings described below are merely a part of the embodiments of the present disclosure. Based on these drawings, those skilled in the art can obtain other drawings without any creative effort.

DESCRIPTION OF EMBODIMENTS

In order to better understand technical solutions of the present disclosure, embodiments of the present disclosure are described in detail with reference to the drawings. It should be clear that the embodiments described are merely part of the embodiments of the present disclosure rather than all of the embodiments. All other embodiments obtained by those skilled in the art without paying creative effort shall fall into the protection scope of the present disclosure.

The terms used in the embodiments of the present disclosure are merely for the describing embodiments and not intended to limit the present disclosure. Unless otherwise noted in the context, the expressions in singular form, such as "a", "an", "the" and "said" used in the embodiments and appended claims of the present disclosure, also represent a plural form.

In the related art, when reducing a light-emitting time of a light-emitting device, color cast will occur in an image in a case where brightness of an organic light-emitting display panel is relatively low, due to influence of a leakage current of a sub-pixel. The color cast caused by changing the light-emitting time of the light-emitting device can be solved in the embodiments of the present disclosure.

Figure 1:
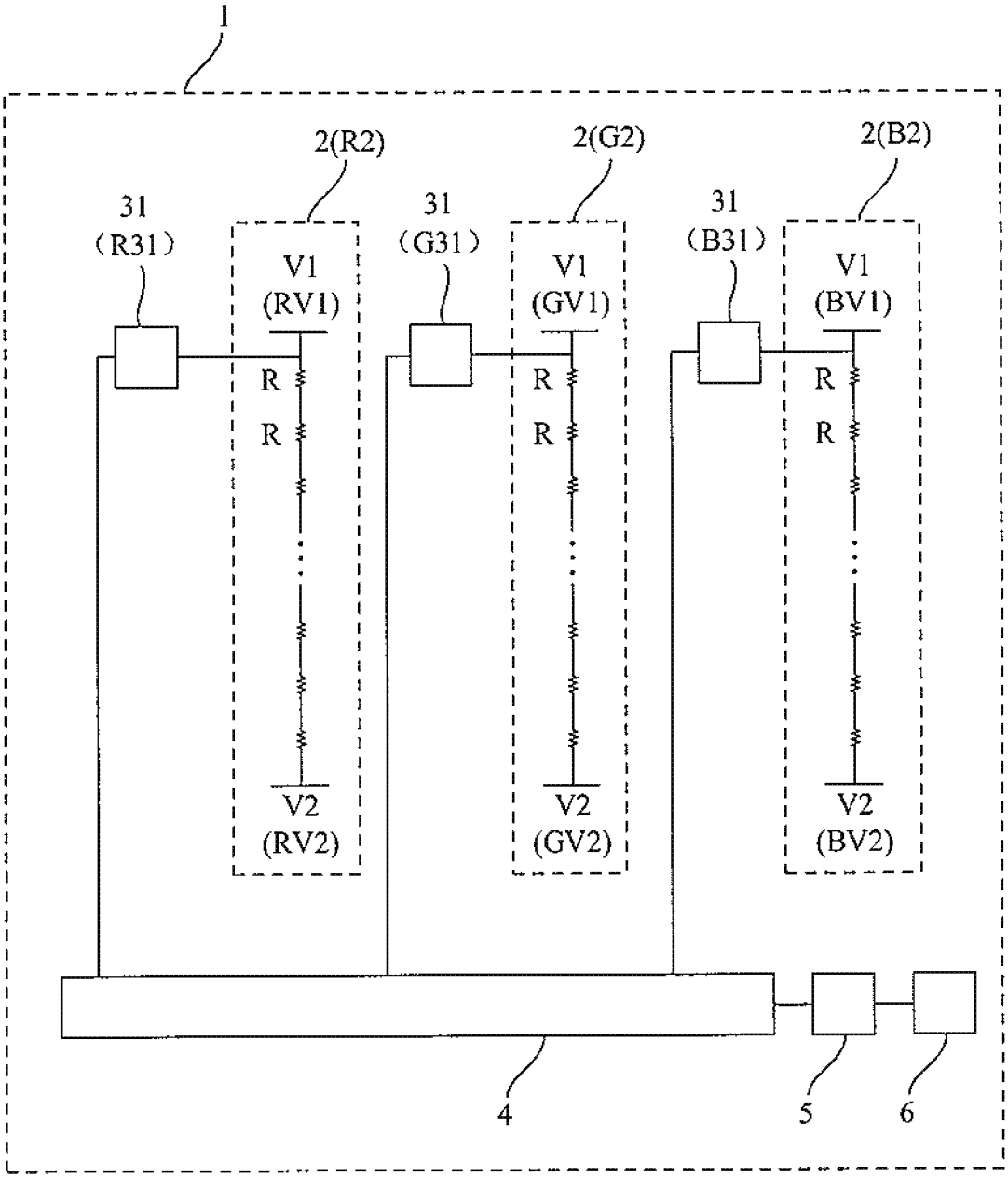
FIG. 1 illustrates a schematic diagram of a driving chip according to an embodiment of the present disclosure.

FIG. 1 illustrates a schematic diagram of a driving chip according to an embodiment of the present disclosure. An embodiment of the present disclosure provides a driving chip 1 applied to a display panel. The display panel includes sub-pixels of different colors and the sub-pixels of different colors constitute one pixel to achieve a display of one colorful pixel by a combination of different colors. The driving chip 1 is configured to drive the display panel to display an image. The driving chip 1 includes: Gamma voltage generating circuits 2, first power supply voltage output circuits 31 and a color cast adjustment circuit 4. The Gamma voltage generating circuits 2 correspond to sub-pixels of different colors. That the Gamma voltage generating circuits 2 correspond to sub-pixels of different colors indicates that one Gamma voltage generating circuit 2 corresponds to one sub-pixel of one color. For example, the display panel includes sub-pixels of three different colors of red, green and blue, and therefore the driving chip 1 is provided with a Gamma voltage generating circuit R2 of a red sub-pixel, a Gamma voltage generating circuit G2 of a green sub-pixel and a Gamma voltage generating circuit B2 corresponding to a blue sub-pixel. R2 corresponds to the red sub-pixel and G2 corresponds to the green sub-pixel. Each of the Gamma voltage generating circuits 2 is configured only to drive a sub-pixel of a corresponding color. For example, a Gamma voltage generated by the Gamma voltage generating circuit R2 of the red sub-pixel is transmitted only to the red sub-pixel and is not transmitted to the green nor blue sub-pixel. Each Gamma voltage generating circuit 2 includes a first power supply voltage terminal V1 and a second power supply voltage terminal V2 that are separate, and a resistor R connected in series between the first power supply voltage terminal V1 and the second power supply voltage terminal V2. The resistor R is configured to divide a voltage between the first power supply voltage terminal V1 and the second power supply voltage terminal V2 to obtain a multi-level voltages. The Gamma voltage generating circuit 2 selects a divided voltage, thus generating the Gamma voltage. The Gamma voltage is configured to be output to the display panel to generate a corresponding driving current. A driving current flows through a light-emitting device corresponding to the sub-pixel, to drive the light-emitting device to emit light. A light-emitting brightness of the light-emitting device is relevant to the driving current. That is, the light-emitting brightness of the light-emitting device is relevant to the Gamma voltage output from the Gamma voltage generating circuit 2, and levels of divided voltages represent levels of changes of grayscales of the light-emitting device. In an embodiment of the present disclosure, the Gamma voltage generated by different Gamma voltage generating circuit 2 is configured to be output to a sub-pixel of a corresponding color. The first power supply voltage output circuits 31 are correspondingly electrically connected to different Gamma voltage generating circuits 2, the first power supply voltage output circuit 31 is configured to output a first power supply voltage to a corresponding first power supply voltage terminal V1. A color cast adjustment circuit 4 is electrically connected to each first power supply voltage output circuit 31 and is configured to adjust the first power supply voltage output by at least one first power supply voltage output circuit 31 according to a light-emitting duration of the light-emitting device in the display panel per unit time.

In an embodiment of the present disclosure, due to existence of the Gamma voltage generating circuits 2 corresponding to sub-pixels of different colors, Gamma voltages required by the sub-pixels of different color can be independently supplied by the Gamma voltage generating circuits 2. The Gamma voltage is obtained by dividing the voltage between the first power supply voltage and the second power supply voltage. The first power supply voltage in each of the Gamma voltage generating circuits 2 is supplied by a corresponding first power supply voltage output circuit 31. The first power supply voltage output circuit 31 can have a circuit structure (such as a booster circuit and the like) in which an output voltage is adjustable. Therefore, the first power supply voltage in each Gamma voltage generating circuit 2 can be independently adjusted. The Gamma voltage is related to the first power supply voltage, the second power supply voltage and an input signal. For example, the Gamma voltage Vdata generated by each Gamma voltage generating circuit 2 satisfies a following formula: $Vdata=VGMP-(VGMP-VGSP)\times S\div 2047$, where 2047 is a constant, S is an input signal configured to reflect an actual brightness of a corresponding sub-pixel in the image, VGMP is the first power supply voltage, and VGSP is the second power supply voltage; or VGMP is the second power supply voltage, and VGSP is the first power supply voltage. Since the color cast is generated after the light-emitting time of the light-emitting device is changed, a relationship between the light-emitting time of the light-emitting device and the color cast can be determined in advance. During normal operation of the display panel, when the light-emitting time of the light-emitting device is changed, the first power supply voltage in at least one Gamma voltage generating circuit 2 can be synchronously adjusted, in order to change a brightness ratio of the sub-pixels of different colors. When the brightness ratio of the sub-pixels of different colors is compensated to a standard value, the color cast caused by a change in the light-emitting time of the light-emitting device can be improved.

The driving chip in embodiments of the present disclosure can synchronously adjust the first power supply voltage in at least one Gamma voltage generating circuit 2 when the light-emitting time of the light-emitting device in the display panel is changed, which changes a brightness ratio of the sub-pixels of different colors. When the brightness ratio of the sub-pixels of different colors is compensated to the standard value, the color cast caused by changing the light-emitting time of the light-emitting device can be improved.

Figure 2:
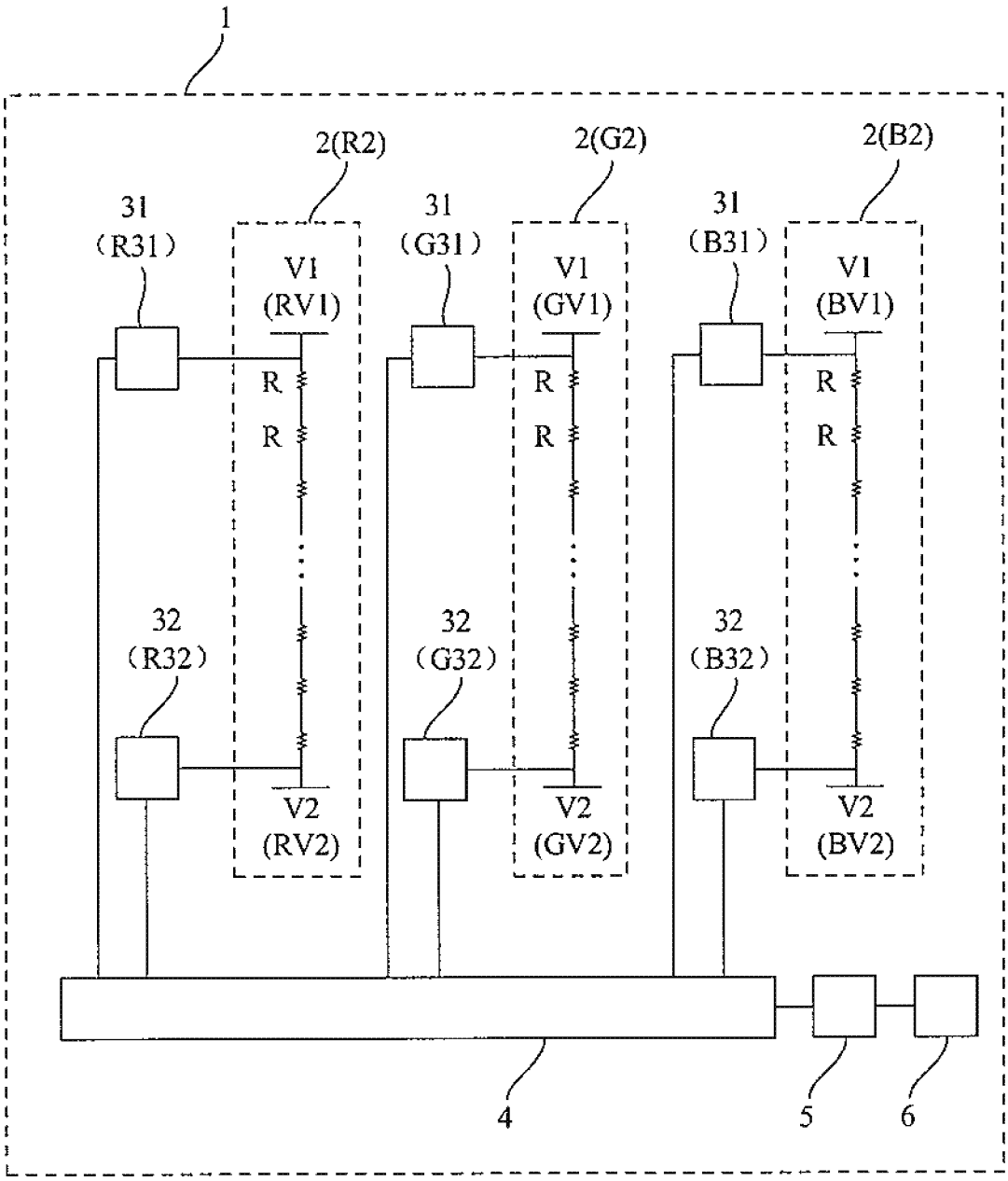
FIG. 2 illustrates a schematic diagram of another driving chip according to an embodiment of the present disclosure.

In some embodiments, in the structure shown in FIG. 1, for each Gamma voltage generating circuit 2, an adjustment of the brightness ratio of the sub-pixels of different colors can be completed by adjusting the first power supply voltage of the first power supply voltage terminal V1. Therefore, the second power supply voltage terminal V2 in each Gamma voltage generating circuit 2 can be connected to a fixed potential. For example, a same voltage is generated by a same circuit and is output to each second power supply voltage terminal V2 of each Gamma voltage generating circuits 2, i.e., the second power supply voltage terminals V2 in each Gamma voltage generating circuit 2 have a same voltage. For each Gamma voltage generating circuit 2, an adjustment of the brightness ratio of the sub-pixels of different colors can also be implemented by simultaneously adjusting the first power supply voltage and the second power supply voltage. For example, FIG. 2 illustrates a schematic diagram of another driving chip according to an embodiment of the present disclosure, and the driving chip 1 further includes second power supply voltage output circuits 32. The second power supply voltage output circuits 32 are correspondingly electrically connected to different Gamma voltage generating circuits 2. The second power supply voltage output circuit 32 is configured to output a second power supply voltage to a corresponding second power supply voltage terminal V2. The color cast adjustment circuit 4 is electrically connected to each second power supply voltage output circuit 32. The color cast adjustment circuit 4 is configured to adjust the first power supply voltage and the second power supply voltage corresponding to at least one Gamma voltage generating circuit 2 according to the light-emitting duration of the light-emitting device in the display panel per unit time. Changing the brightness ratio of the sub-pixels of different colors by simultaneously adjusting the first power supply voltage and the second power supply voltage in a same Gamma voltage generating circuit 2 can make adjustment be faster and a voltage adjustment range be wider.

In some embodiments, as shown in FIG. 1 and FIG. 2, the driving chip 1 further includes a brightness adjustment register 5 and a light-emitting control signal generating circuit 6. The brightness adjustment register 5 is electrically connected to the color cast adjustment circuit 4 and is configured to store a brightness datum. The light-emitting control signal generating circuit 6 is electrically connected to the brightness adjustment register 5 and is configured to generate a light-emitting control signal according to the brightness datum in the brightness adjustment register 5, thus causing a scan driving circuit in the display panel to adjust the light-emitting duration of the light-emitting device in the display panel per unit time according to the light-emitting control signal. The color cast adjustment circuit 4 is configured to acquire brightness datum in the brightness adjustment register 5 and to adjust, according to the brightness datum, the first power supply voltage output by at least one first power supply voltage output circuit 31.

In some embodiments, the brightness datum determined by a user is stored in the brightness adjustment register 5, and when the user adjusts a brightness, the brightness datum in the brightness adjustment register 5 will change accordingly. The light-emitting control signal generating circuit 6 is configured to generate the light-emitting control signal configured to control the scan driving circuit in the display panel. For example, the light-emitting control signal can be a pulse signal, and the pulse signal is output to a clock signal terminal in the scan driving circuit and is taken as a clock signal of the scan driving circuit. The scan driving circuit provides a scan signal to a pixel driving circuit corresponding to each sub-pixel. For example, when the pixel driving circuit has received a light-emitting control cutoff voltage output by the scan driving circuit, a flow path for driving current is cut off, so that the driving current cannot flow through the light-emitting device and thus the light-emitting device stops emitting light. The larger a width of a pulse of the light-emitting control signal, the longer the light-emitting duration of the light-emitting device per unit time. Namely, the brightness datum stored in the brightness adjustment register 5 can reflect the light-emitting duration of the light-emitting device in the display panel per unit time. Therefore, the color cast adjustment circuit 4 can adjust a power supply voltage in the Gamma voltage generating circuit 2 according to the brightness datum in the brightness adjustment register 5.

In some embodiments, the color cast adjustment circuit 4 is configured to periodically acquire the brightness datum in the brightness adjustment register 5. If an acquired brightness datum and the first power supply voltages output by the first power supply voltage output circuits 31 do not satisfy a preset brightness-voltage mapping relationship, the first power supply voltage output by at least one first power supply voltage output circuit 31 is adjusted in such a manner that a current brightness datum and the first power supply voltages output by the first power supply voltage output circuits 31 satisfy the preset brightness-voltage mapping relationship.

For example, the Gamma voltage generating circuit 2 includes a Gamma voltage generating circuit R2 of a red sub-pixel, a Gamma voltage generating circuit G2 of a green sub-pixel and a Gamma voltage generating circuit B2 of a blue sub-pixel. The Gamma voltage generating circuit R2 of the red sub-pixel includes a first power supply voltage terminal RV1 of the red sub-pixel and a second power supply voltage terminal RV2 of the red sub-pixel. The Gamma voltage generating circuit G2 of the green sub-pixel includes a first power supply voltage terminal GV1 of the green sub-pixel and a second power supply voltage terminal GV2 of the green sub-pixel. The Gamma voltage generating circuit B2 of the blue sub-pixel includes a first power supply voltage terminal BV1 of the blue sub-pixel and a second power supply voltage terminal BV2 of the blue sub-pixel. The first power supply voltage output circuit 31 includes a first power supply voltage output circuit R31 of the red sub-pixel, a first power supply voltage output circuit G31 of the green sub-pixel, and a first power supply voltage output circuit B31 of the blue sub-pixel. An output terminal of the first power supply voltage output circuit R31 of the red sub-pixel is electrically connected to the first power supply voltage terminal RV1 of the red sub-pixel, and an output voltage adjustment terminal of the first power supply voltage output circuit R31 of the red sub-pixel is electrically connected to the color cast adjustment circuit 4. An output terminal of the first power supply voltage output circuit G31 of the green sub-pixel is electrically connected to the first power supply voltage terminal GV1 of the green sub-pixel, and an output voltage adjustment terminal of the first power supply voltage output circuit G31 of the green sub-pixel is electrically connected to the color cast adjustment circuit 4. An output terminal of the first power supply voltage output circuit B31 of the blue sub-pixel is electrically connected to the first power supply voltage terminal BV1 of the blue sub-pixel, and an output voltage adjustment terminal of the first power supply voltage output circuit B31 of the blue sub-pixel is electrically connected to the color cast adjustment circuit 4. In the structure shown in FIG. 2, the second power supply voltage output circuit 32 includes a second power supply voltage output circuit R32 of the red sub-pixel, a second power supply voltage output circuit G32 of the green sub-pixel, and a second power supply voltage output circuit B32 of the blue sub-pixel. An output terminal of the second power supply voltage output circuit R32 of the red sub-pixel is electrically connected to the second power supply voltage terminal RV2 of the red sub-pixel, and an output voltage adjustment terminal of the second power supply voltage output circuit R32 of the red sub-pixel is electrically connected to the color cast adjustment circuit 4. An output terminal of the second power supply voltage output circuit G32 of the green sub-pixel is electrically connected to the second power supply voltage terminal GV2 of the green sub-pixel, and an output voltage adjustment terminal of the second power supply voltage output circuit G32 of the green sub-pixel is electrically connected to the color cast adjustment circuit 4. An output terminal of the second power supply voltage output circuit B32 of the blue sub-pixel is electrically connected to the second power supply voltage terminal BV2 of the blue sub-pixel, and an output voltage adjustment terminal of the second power supply voltage output circuit B32 of the blue sub-pixel is electrically connected to the color cast adjustment circuit 4.

In some embodiments, a relationship between the light-emitting duration of the light-emitting device and the first power supply voltage of the different-color sub-pixel Gamma voltage generating circuit, i.e., the preset brightness-voltage mapping relationship, can be determined in advance by testing. When the mapping relationship is satisfied, the display panel will not have the color cast or a color cast degree is relatively low. For example, Table 1 is an example of a table of the brightness-voltage mapping relationship in the embodiment of the present disclosure.

TABLE 1

| Brightness of Display Panel | RGB Voltage Relationship | | |
|---|---|---|---|
| (unit: nit) | R | G | B |
| (200-400] | 6 V | 6 V | 6 V |
| (100-200] | 5.7 V | 6 V | 6 V |
| (50-100] | 5.5 V | 5.8 V | 6 V |

The brightness of the display panel represents a brightness of the display panel under a white screen, and the RGB voltage relationship represents the first power supply voltage of Gamma voltage generating circuit 2 of sub-pixels of different colors. R represents the first power supply voltage of the Gamma voltage generating circuit R2 of the red sub-pixel. G represents the first power supply voltage of the Gamma voltage generating circuit G2 of the green sub-pixel. B represents the first power supply voltage of the Gamma voltage generating circuit B2 of the blue sub-pixel. For example, the color cast adjustment circuit 4 acquires the brightness datum in the brightness adjustment register 5 at regular intervals and determines whether the acquired brightness datum and a current first power supply voltages of Gamma voltage generating circuits 2 satisfy the mapping relationship above. For example, at a first point t1, the acquired brightness datum is 400 nit, and at this time, the first power supply voltage of each Gamma voltage generating circuit 2 is 6V, i.e., the mapping relationship above is satisfied, and no adjustment is performed. At a second point t2, the acquired brightness datum is 300 nit, and at this time, the first power supply voltage of each Gamma voltage generating circuits 2 is 6V, and at this time, it is determined that a relationship between the brightness datum and current first power supply voltages corresponding to the Gamma voltage generating circuits 2 does not satisfy the mapping relationship above. Therefore, an adjustment is performed on the first power supply voltage of the Gamma voltage generating circuit R2 of the red sub-pixel, i.e., an output voltage of the first power supply voltage output circuit R31 of the red sub-pixel is controlled to become 5.7V, and an output voltages of the first power supply voltage output circuit G31 of the green sub-pixel and an output voltage of the first power supply voltage output circuit B31 of the blue sub-pixel are unchanged and are still 6V. After such adjustment, the color cast of the display panel is improved. The brightness-voltage mapping relationship in Table 1 includes only the relationship between the first power supply voltages in the Gamma voltage generating circuits 2, i.e., adjusting the brightness ratio of the sub-pixels of different colors is achieved by changing only the first power supply voltage. In other implementable embodiments, such as in the structure corresponding to FIG. 2, the brightness-voltage relationship includes not only the relationship between the first power supply voltages in the Gamma voltage generating circuits 2, but also the relationship between the second power supply voltages in the Gamma voltage generating circuits 2. When it is determined that the acquired brightness datum and current first power supply voltages and current second power supply voltages of the Gamma voltage generating circuits 2 do not satisfy the mapping relationship, adjustment is performed on the first power supply voltage and/or the second power supply voltage that doesn't satisfy the relationship.

In some embodiments, after the color cast adjustment circuit 4 performs an adjustment on the first power supply voltage output by at least one first power supply voltage output circuit 31 according to the light-emitting time of the light-emitting device in the display panel per unit time, under a condition of the same input signal, the brightness ratio of the red sub-pixel, the green sub-pixel and the blue sub-pixel is different from the brightness ratio of the red sub-pixel, the green sub-pixel and the blue sub-pixel before the adjustment. For example, the Gamma voltage Vdata generated by each Gamma voltage generating circuit 2 satisfies the following formula: $Vdata=VGMP-(VGMP-VGSP)\times S\div 2047$. For example, VGMP is the first power supply voltage, VGSP is the second power supply voltage, and S is an input signal. The color cast adjustment circuit 4 adjusts on the first power supply voltage VGMP of the Gamma voltage generating circuit R2 of the red sub-pixel according to the duration of the light-emitting device in the display panel per unit time. Before and after the adjustment, a Gamma voltage GVdata generated by the Gamma voltage generating circuit G2 of the green sub-pixel is unchanged, and a Gamma voltage BVdata generated by the Gamma voltage generating circuit B2 of the blue sub-pixel is unchanged. Since the first power supply voltage VGMP of the Gamma voltage generating circuit R2 of the red sub-pixel is adjusted, a Gamma voltage RVdata generated by the Gamma voltage generating circuit R2 of the red sub-pixel is changed. Since the Gamma voltage reflects a brightness of a sub-pixel, the brightness ratio of the red sub-pixel, the green sub-pixel and the blue sub-pixel is RVdata: GVdata: BVdata. Before the adjustment, the color cast is caused by the brightness ratio of the red sub-pixel, the green sub-pixel and the blue sub-pixel not reaching a standard brightness ratio, which is caused by a relatively low brightness of the red sub-pixel. Therefore, through embodiments of the present disclosure, after the first power supply voltage output by at least one first power supply voltage output circuit 31 is adjusted, the brightness ratio of the red sub-pixel, the green sub-pixel and the blue sub-pixel is changed, i.e., the brightness ratio of the sub-pixels of different colors can be compensated to the standard value, thereby improving the color cast.

In some embodiments, the color cast adjustment circuit 4 is a micro control unit MCU, and a function of the color cast adjustment circuit 4 is implemented through the MCU in the driving chip 1. The MCU is also configured to control each unit module in the driving chip 1 without separately fabricating a corresponding circuit to implement the function of the color cast adjustment circuit 4.

Figure 3:
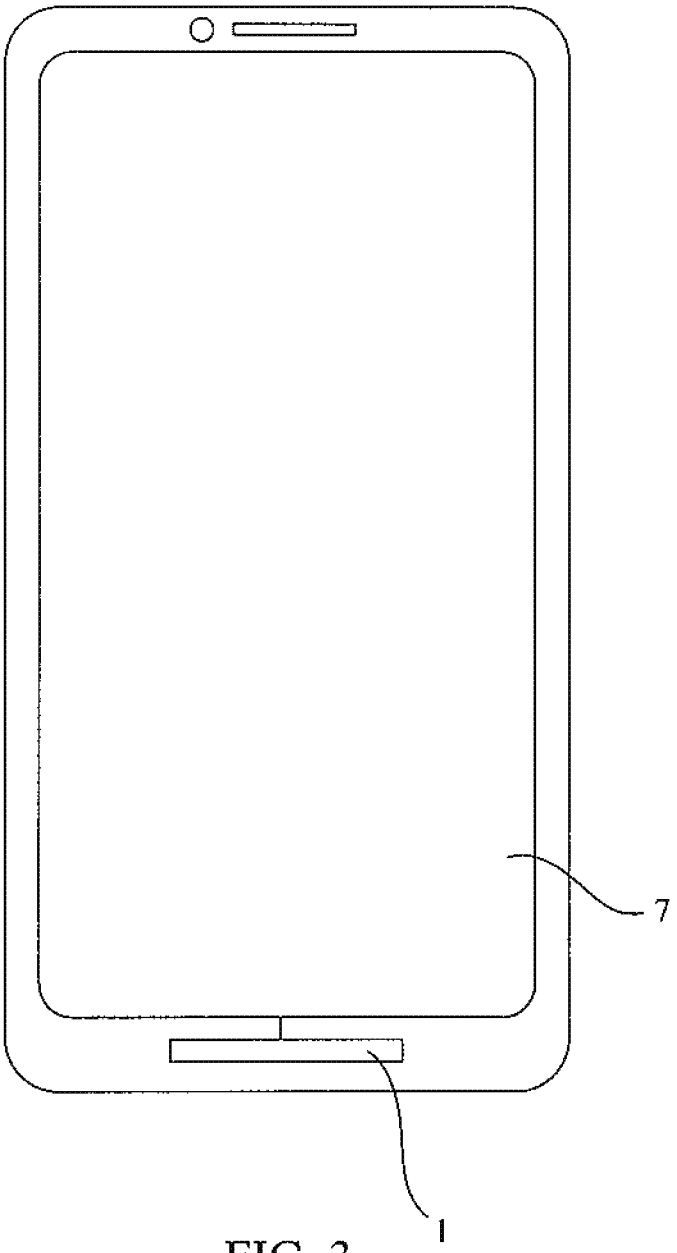
FIG. 3 illustrates a schematic diagram of a display device according to an embodiment of the present disclosure.

As shown in FIG. 3, FIG. 3 illustrates a schematic diagram of a display device according to an embodiment of the present disclosure and the embodiment of the present disclosure further provides a display device including a display panel 7 and the driving chip 1 above.

A structure and principle of the organic light-emitting display panel 7 are the same as those of the foregoing embodiment, which are not repeated herein. The display device can be any electronic device with a display function, such as a touch display screen, a mobile phone, a tablet computer, a notebook computer, an electronic paper book, or a television.

The display device in embodiments of the present disclosure can synchronously adjust the first power supply voltage in at least one Gamma voltage generating circuit when changing the light-emitting time of the light-emitting device in the display panel, in order to change the brightness ratio of the sub-pixels of different colors. When the brightness ratio of the sub-pixels of different colors is compensated to the standard value, the color cast caused by changing the light-emitting time of the light-emitting device can be improved.

As shown in FIG. 1 and FIG. 2, an embodiment of the present disclosure provides a method for controlling a driving chip, and the driving chip 1 includes the Gamma voltage generating circuits 2, the first power supply voltage output circuits 31 and the color cast adjustment circuit 4. The Gamma voltage generating circuits 2 correspond to sub-pixels of different colors. Each of the Gamma voltage generating circuits 2 includes the first power supply voltage terminal V1 and the second power supply voltage terminal V2 that are separate, and the voltage-dividing resistor R connected in series between the first power supply voltage terminal V1 and the second power supply voltage terminal V2. The first power supply voltage output circuits 31 are electrically connected to corresponding different Gamma voltage generating circuits 2. The first power supply voltage output circuit 31 is configured to output the first power supply voltage to the corresponding first power supply voltage terminal V1. The method for controlling the driving chip includes adjusting a first power supply voltage output by at least one first power supply voltage output circuit 31 according to the light-emitting duration of the light-emitting device in the display panel per unit time.

The structure and principle of the driving chip and a process of the method for controlling the driving chip are the same as those in the foregoing embodiment, which are not repeated herein.

The method for controlling the driving chip in the embodiment of the present disclosure can synchronously adjust the first power supply voltage in at least one Gamma voltage generating circuit when changing the light-emitting time of the light-emitting device in the display panel, in order to change the brightness ratio of the sub-pixels of different colors. When the brightness ratio of the sub-pixels of different colors is compensated to the standard value, the color cast caused by changing the light-emitting time of the light-emitting device can be improved.

In some embodiments, as shown in FIG. 2, the driving chip 1 further includes the second power supply voltage output circuits 32. The second power supply voltage output circuits 32 are correspondingly electrically connected to different Gamma voltage generating circuits 2, and is configured to output the second power supply voltage to a corresponding second power supply voltage terminal V2. A process of adjusting a first power supply voltage output by at least one first power supply voltage output circuit 31 according to the light-emitting duration of the light-emitting device in the display panel per unit time includes adjusting the first power supply voltage and the second power supply voltage corresponding to at least one Gamma voltage generating circuit 2 according to the light-emitting duration of the light-emitting device in the display panel per unit time.

In some embodiments, the driving chip 1 further includes the brightness adjustment register 5 and the light-emitting control signal generating circuit 6. The brightness adjustment register 5 is electrically connected to the color cast adjustment circuit 4 and configured to store the brightness datum. The light-emitting control signal generating circuit 6 is electrically connected to the brightness adjustment register 5 and is configured to generate the light-emitting control signal according to the brightness datum, for causing a scan driving circuit in the display panel to adjust a light-emitting duration of the light-emitting device in the display panel per unit time according to the light-emitting control signal. A process of adjusting the first power supply voltage output by at least one first power supply voltage output circuit 31 according to the light-emitting duration of the light-emitting device in the display panel per unit time includes acquiring brightness datum in the brightness adjustment register 5 and adjusting the first power supply voltage output by at least one first power supply voltage output circuit 31 according to the brightness datum.

Figure 4:
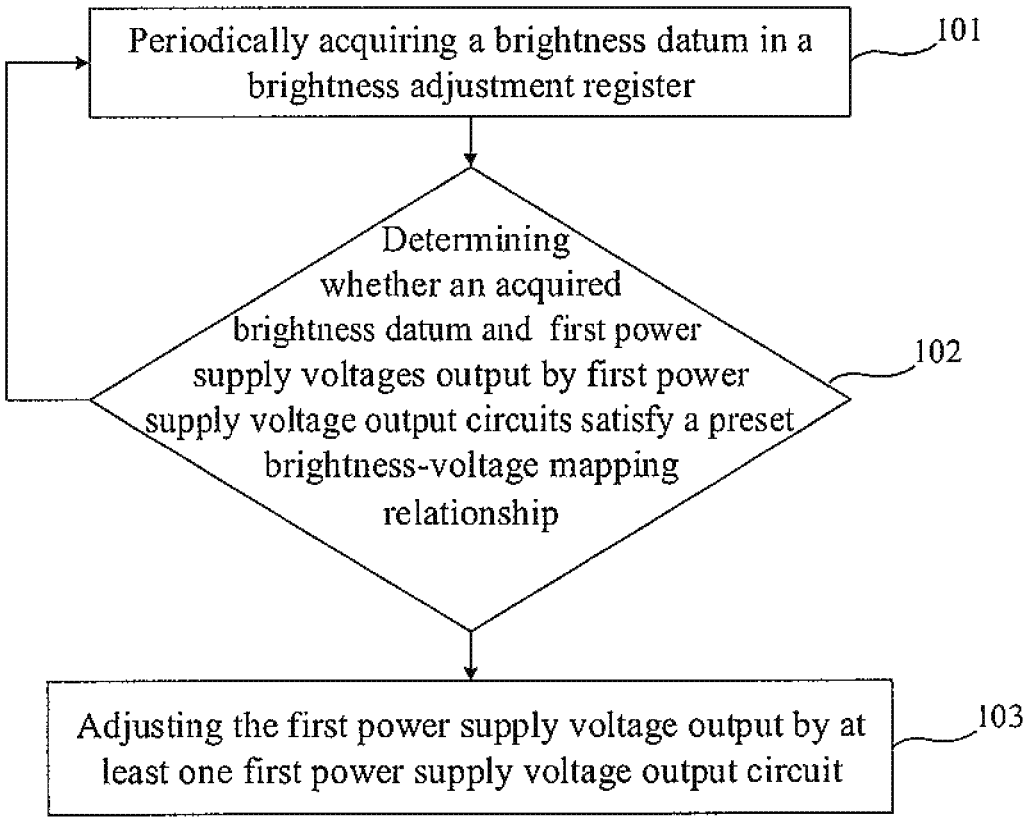
FIG. 4 illustrates a flow chart of a method for controlling a driving chip according to an embodiment of the present disclosure.

In some embodiments, FIG. 4 illustrates a flow chart of a method for controlling a driving chip according to an embodiment of the present disclosure. A process of the acquiring the brightness datum in the brightness adjustment register 5 and adjusting the first power supply voltage output by at least one of the first power supply voltage output circuits 31 according to the brightness datum includes:

step 101: periodically acquiring the brightness datum in the brightness adjustment register 5;

step 102: determining whether an acquired brightness datum and the first power supply voltages output by first power supply voltage output circuits 31 satisfy the preset brightness-voltage mapping relationship, and if the acquired brightness datum and the first power supply voltages output by the first power supply voltage output circuits 31 satisfy the preset brightness-voltage mapping relationship, returning to the step 101, and if the acquired brightness datum and the first power supply voltages output by the first power supply voltage output circuits 31 does not satisfy the preset brightness-voltage mapping relationship, then proceeding to step 103; and step 103: adjusting the first power supply voltage output by at least one first power supply voltage output circuit 31 in such a manner that a current brightness datum and the first power supply voltages output by the first power supply voltage output circuits 31 satisfy the preset brightness-voltage mapping relationship.

In some embodiments, the Gamma voltage generating circuit 2 includes a Gamma voltage generating circuit R2 of a red sub-pixel, a Gamma voltage generating circuit G2 of a green sub-pixel and a Gamma voltage generating circuit B2 of a blue sub-pixel. The Gamma voltage generating circuit R2 of the red sub-pixel includes a first power supply voltage terminal RV1 of the red sub-pixel and a second power supply voltage terminal RV2 of the red sub-pixel. The Gamma voltage generating circuit G2 of the green sub-pixel includes a first power supply voltage terminal GV1 of the green sub-pixel and a second power supply voltage terminal GV2 of the green sub-pixel. The Gamma voltage generating circuit B2 of the blue sub-pixel includes a first power supply voltage terminal BV1 of the blue sub-pixel and a second power supply voltage terminal BV2 of the blue sub-pixel. The first power supply voltage output circuit 31 includes a first power supply voltage output circuit R31 of the red sub-pixel, a first power supply voltage output circuit G31 of the green sub-pixel, and a first power supply voltage output circuit B31 of the blue sub-pixel. An output terminal of the first power supply voltage output circuit R31 of the red sub-pixel is electrically connected to the first power supply voltage terminal RV1 of the red sub-pixel, and an output voltage adjustment terminal of the first power supply voltage output circuit R31 of the red sub-pixel is electrically connected to the color cast adjustment circuit 4. An output terminal of the first power supply voltage output circuit G31 of the green sub-pixel is electrically connected to the first power supply voltage terminal GV1 of the green sub-pixel, and an output voltage adjustment terminal of the first power supply voltage output circuit G31 of the green sub-pixel is electrically connected to the color cast adjustment circuit 4. An output terminal of the first power supply voltage output circuit B31 of the blue sub-pixel is electrically connected to the first power supply voltage terminal BV1 of the blue sub-pixel, and an output voltage adjustment terminal of the first power supply voltage output circuit B31 of the blue sub-pixel is electrically connected to the color cast adjustment circuit 4. In the structure shown in FIG. 2, the second power supply voltage output circuit 32 includes a second power supply voltage output circuit R32 of the red sub-pixel, a second power supply voltage output circuit G32 of the green sub-pixel, and a second power supply voltage output circuit B32 of the blue sub-pixel. An output terminal of the second power supply voltage output circuit R32 of the red sub-pixel is electrically connected to the second power supply voltage terminal RV2 of the red sub-pixel, and an output voltage adjustment terminal of the second power supply voltage output circuit R32 of the red sub-pixel is electrically connected to the color cast adjustment circuit 4. An output terminal of the second power supply voltage output circuit G32 of the green sub-pixel is electrically connected to the second power supply voltage terminal GV2 of the green sub-pixel, and an output voltage adjustment terminal of the second power supply voltage output circuit G32 of the green sub-pixel is electrically connected to the color cast adjustment circuit 4. An output terminal of the second power supply voltage output circuit B32 of the blue sub-pixel is electrically connected to the second power supply voltage terminal BV2 of the blue sub-pixel, and an output voltage adjustment terminal of the second power supply voltage output circuit B32 of the blue sub-pixel is electrically connected to the color cast adjustment circuit 4.

In some embodiments, after the color cast adjustment circuit 4 performs an adjustment on the first power supply voltage output by at least one first power supply voltage output circuit 31 according to the light-emitting duration of the light-emitting device in the display panel per unit time, under a condition of the same input signal, the brightness ratio of the red sub-pixel, the green sub-pixel and the blue sub-pixel is different from the brightness ratio of the red sub-pixel, the green sub-pixel and the blue sub-pixel before the adjustment.

The above are only some embodiments of the present disclosure and are not intended to limit the present disclosure. Any modifications, equivalents, improvements, etc., which are made within the spirit and principles of the present disclosure, should be included in the scope of the present disclosure.

It should be understood that, the embodiments above-described are merely for illustrating technical solutions of the present disclosure rather than limit the present disclosure. Although the present disclosure has been described in detail with reference to the embodiments above-described, it should be understood by those skilled in the art that, it is still possible to modify the technical solutions described in the embodiments above or to equivalently alternate some or all of the technical features therein, but these modifications or alternatives do not cause the essence of corresponding technical solutions to depart from the scope of the present disclosure.

What is claimed is:

1. A driving chip operationally coupled to a display panel, the driving chip comprising:

Gamma voltage generating circuits, wherein the Gamma voltage generating circuits correspond to sub-pixels of different colors, wherein each of the Gamma voltage generating circuits corresponds to one sub-pixel of one color of the sub-pixels of different colors, and each of the Gamma voltage generating circuits comprises a first power supply voltage terminal and a second power supply voltage terminal that are separate, and a resistor connected in series between the first power supply voltage terminal and the second power supply voltage terminal;

first power supply voltage output circuits electrically connected to different Gamma voltage generating circuits, each of the first power supply voltage output circuits being configured to output a first power supply voltage to the first power supply voltage terminal of a corresponding one of the Gamma voltage generating circuits;

second power supply voltage output circuits electrically connected to different Gamma voltage generating circuits, each of the second power supply voltage output circuits being configured to output a second power supply voltage to the second power supply voltage terminal of a corresponding one of the Gamma voltage generating circuits; and a color cast adjustment circuit, wherein the color cast adjustment circuit is electrically connected to each of the first power supply voltage output circuits and is electrically connected to each of the second power supply voltage output circuits, and wherein the color cast adjustment circuit is configured to adjust the first power supply voltage and the second power supply voltage that correspond to at least one of the Gamma voltage generating circuits according to a light-emitting duration of a light-emitting device in the display panel per unit time.

2. The driving chip according to claim 1, further comprising:

a brightness adjustment register electrically connected to the color cast adjustment circuit and configured to store a brightness datum; and a light-emitting control signal generating circuit electrically connected to the brightness adjustment register and configured to generate a light-emitting control signal according to the brightness datum, wherein a scan driving circuit in the display panel is configured to adjust the light-emitting duration of the light-emitting device in the display panel per unit time according to the light-emitting control signal;

wherein the color cast adjustment circuit is configured to acquire the brightness datum in the brightness adjustment register and to adjust, according to the brightness datum, the first power supply voltage output by at least one of the first power supply voltage output circuits.

3. The driving chip according to claim 2, wherein the color cast adjustment circuit is configured to periodically acquire the brightness datum in the brightness adjustment register; and, in a condition where an acquired brightness datum and the first power supply voltages output by the first power supply voltage output circuits do not satisfy a preset brightness-voltage mapping relationship, the color cast adjustment circuit is configured to adjust the first power supply voltage output by at least one of the first power supply voltage output circuits in such a manner that a current brightness datum and the first power supply voltage output by first power supply voltage output circuits satisfy the preset brightness-voltage mapping relationship.

4. The driving chip according to claim 1, wherein each of the Gamma voltage generating circuits comprises:

a Gamma voltage generating circuit of a red sub-pixel, wherein the Gamma voltage generating circuit of the red sub-pixel comprises a first power supply voltage terminal of the red sub-pixel and a second power supply voltage terminal of the red sub-pixel;

a Gamma voltage generating circuit of a green sub-pixel, wherein the Gamma voltage generating circuit of the green sub-pixel comprises a first power supply voltage terminal of the green sub-pixel and a second power supply voltage terminal of the green sub-pixel; and a Gamma voltage generating circuit of a blue sub-pixel, wherein the Gamma voltage generating circuit of the blue sub-pixel comprises a first power supply voltage terminal of the blue sub-pixel and a second power supply voltage terminal of the blue sub-pixel; and wherein the first power supply voltage output circuit comprises:

a first power supply voltage output circuit of the red sub-pixel, wherein an output terminal of the first power supply voltage output circuit of the red sub-pixel is electrically connected to the first power supply voltage terminal of the red sub-pixel, and an output voltage adjustment terminal of the first power supply voltage output circuit of the red sub-pixel is electrically connected to the color cast adjustment circuit;

a first power supply voltage output circuit of the green sub-pixel, wherein an output terminal of the first power supply voltage output circuit of the green sub-pixel is electrically connected to the first power supply voltage terminal of the green sub-pixel, and an output voltage adjustment terminal of the first power supply voltage output circuit of the green sub-pixel is electrically connected to the color cast adjustment circuit; and a first power supply voltage output circuit of the blue sub-pixel, wherein an output terminal of the first power supply voltage output circuit of the blue sub-pixel is electrically connected to the first power supply voltage terminal of the blue sub-pixel, and an output voltage adjustment terminal of the first power supply voltage output circuit of the blue sub-pixel is electrically connected to the color cast adjustment circuit.

5. The driving chip according to claim 4, wherein after the color cast adjustment circuit performs an adjustment to the first power supply voltage output by at least one of the first power supply voltage output circuits according to the light-emitting duration of the light-emitting device in the display panel per unit time, under a condition of a same input signal, a brightness ratio of the red sub-pixel, the green sub-pixel and the blue sub-pixel after the adjustment is different from a brightness ratio of the red sub-pixel, the green sub-pixel and the blue sub-pixel before the adjustment.

6. The driving chip according to claim 1, wherein the color cast adjustment circuit is a micro control unit (MCU).

7. A display device, comprising a display panel and a driving chip applied in the display panel, wherein the driving chip comprises:

Gamma voltage generating circuits, wherein the Gamma voltage generating circuits correspond to sub-pixels of different colors, wherein each of the Gamma voltage generating circuits corresponds to one sub-pixel of one color of the sub-pixels of different colors, and wherein each of the Gamma voltage generating circuits comprises a first power supply voltage terminal and a second power supply voltage terminal that are separate, and a resistor connected in series between the first power supply voltage terminal and the second power supply voltage terminal;

first power supply voltage output circuits electrically connected to different Gamma voltage generating circuits, each of the first power supply voltage output circuits being configured to output a first power supply voltage to the first power supply voltage terminal of a corresponding one of the Gamma voltage generating circuits;

second power supply voltage output circuits electrically connected to different Gamma voltage generating circuits, each of the second power supply voltage output circuits being configured to output a second power supply voltage to the second power supply voltage terminal of a corresponding one of the Gamma voltage generating circuits; and a color cast adjustment circuit, wherein the color cast adjustment circuit is electrically connected to each of the first power supply voltage output circuits and is electrically connected to each of the second power supply voltage output circuits, and wherein the color cast adjustment circuit is configured to adjust the first power supply voltage and the second power supply voltage that correspond to at least one of the Gamma voltage generating circuits according to a light-emitting duration of a light-emitting device in the display panel per unit time.

8. The display device according to claim 7, wherein the driving chip further comprises:

a brightness adjustment register electrically connected to the color cast adjustment circuit and configured to store a brightness datum; and a light-emitting control signal generating circuit electrically connected to the brightness adjustment register and configured to generate a light-emitting control signal according to the brightness datum, wherein a scan driving circuit in the display panel is configured to adjust the light-emitting duration of the light-emitting device in the display panel per unit time according to the light-emitting control signal;

wherein the color cast adjustment circuit is configured to acquire the brightness datum in the brightness adjustment register and to adjust, according to the brightness datum, the first power supply voltage output by at least one of the first power supply voltage output circuits.

9. The display device according to claim 8, wherein the color cast adjustment circuit is configured to periodically acquire the brightness datum in the brightness adjustment register; and in a condition where an acquired brightness datum and the first power supply voltages output by the first power supply voltage output circuits do not satisfy a preset brightness-voltage mapping relationship, the color cast adjustment circuit is configured to adjust the first power supply voltage output by at least one of the first power supply voltage output circuits in such a manner that a current brightness datum and the first power supply voltage output by first power supply voltage output circuits satisfy the preset brightness-voltage mapping relationship.

10. The display device according to claim 7, wherein each of the Gamma voltage generating circuits comprises:

a Gamma voltage generating circuit of a red sub-pixel, wherein the Gamma voltage generating circuit of the red sub-pixel comprises a first power supply voltage terminal of the red sub-pixel and a second power supply voltage terminal of the red sub-pixel;

a Gamma voltage generating circuit of a green sub-pixel, wherein the Gamma voltage generating circuit of the green sub-pixel comprises a first power supply voltage terminal of the green sub-pixel and a second power supply voltage terminal of the green sub-pixel; and a Gamma voltage generating circuit of a blue sub-pixel, wherein the Gamma voltage generating circuit of the blue sub-pixel comprises a first power supply voltage terminal of the blue sub-pixel and a second power supply voltage terminal of the blue sub-pixel; and wherein the first power supply voltage output circuit comprises:

a first power supply voltage output circuit of the red sub-pixel, wherein an output terminal of the first power supply voltage output circuit of the red sub-pixel is electrically connected to the first power supply voltage terminal of the red sub-pixel, and an output voltage adjustment terminal of the first power supply voltage output circuit of the red sub-pixel is electrically connected to the color cast adjustment circuit;

a first power supply voltage output circuit of the green sub-pixel, wherein an output terminal of the first power supply voltage output circuit of the green sub-pixel is electrically connected to the first power supply voltage terminal of the green sub-pixel, and an output voltage adjustment terminal of the first power supply voltage output circuit of the green sub-pixel is electrically connected to the color cast adjustment circuit; and a first power supply voltage output circuit of the blue sub-pixel, wherein an output terminal of the first power supply voltage output circuit of the blue sub-pixel is electrically connected to the first power supply voltage terminal of the blue sub-pixel, and an output voltage adjustment terminal of the first power supply voltage output circuit of the blue sub-pixel is electrically connected to the color cast adjustment circuit.

11. The display device according to claim 10, wherein after the color cast adjustment circuit performs an adjustment to the first power supply voltage output by at least one of the first power supply voltage output circuits according to the light-emitting duration of the light-emitting device in the display panel per unit time, under a condition of a same input signal, a brightness ratio of the red sub-pixel, the green sub-pixel and the blue sub-pixel after the adjustment is different from a brightness ratio of the red sub-pixel, the green sub-pixel and the blue sub-pixel before the adjustment.

12. The display device according to claim 7, wherein the color cast adjustment circuit is a micro control unit (MCU).

13. A method for controlling a driving chip, wherein the driving chip comprises:

Gamma voltage generating circuits, wherein the Gamma voltage generating circuits correspond to sub-pixels of different colors, wherein each of the Gamma voltage generating circuits corresponds to one sub-pixel of one color of the sub-pixels of different colors, and each of the Gamma voltage generating circuits comprises a first power supply voltage terminal and a second power supply voltage terminal that are separate, and a voltage-dividing resistor connected in series between the first power supply voltage terminal and the second power supply voltage terminal;

first power supply voltage output circuits electrically connected to different Gamma voltage generating circuits, each of the first power supply voltage output circuits being configured to output a first power supply voltage to the first power supply voltage terminal of a corresponding one of the Gamma voltage generating circuits; and second power supply voltage output circuits electrically connected to different Gamma voltage generating circuits, each of the second power supply voltage output circuits being configured to output a second power supply voltage to the second power supply voltage terminal of a corresponding one of the Gamma voltage generating circuits;

wherein the method for controlling the driving chip comprises:

adjusting the first power supply voltage and the second power supply voltage that correspond to at least one of the Gamma voltage generating circuits according to a light-emitting duration of a light-emitting device in a display panel per unit time.

14. The method for controlling the driving chip according to claim 13, wherein the driver chip further comprises:

a brightness adjustment register electrically connected to the color cast adjustment circuit and configured to store a brightness datum; and a light-emitting control signal generating circuit electrically connected to the brightness adjustment register and configured to generate a light-emitting control signal according to the brightness datum, wherein a scan driving circuit in the display panel is configured to adjust the light-emitting duration of the light-emitting device in the display panel per unit time according to the light-emitting control signal;

wherein said adjusting the first power supply voltage output by at least one of the first power supply voltage output circuit according to the light-emitting duration of the light-emitting device in the display panel per unit time comprises:

acquiring the brightness datum in the brightness adjustment register and adjusting the first power supply voltage output by at least one of the first power supply voltage output circuits according to the brightness datum.

15. The method for controlling the driving chip according to claim 14, wherein said acquiring the brightness datum in the brightness adjustment register and adjusting the first power supply voltage output by at least one of the first power supply voltage output circuits according to the brightness datum comprises:

periodically acquiring the brightness datum in the brightness adjustment register;

in a condition where an acquired brightness datum and the first power supply voltages output by the first power supply voltage output circuits do not satisfy a preset brightness-voltage mapping relationship, the first power supply voltage output by at least one of the first power supply voltage output circuits is adjusted in such a manner that a current brightness datum and the first power supply voltages output by the first power supply voltage output circuits satisfy the preset brightness-voltage mapping relationship.

16. The method for controlling the driving chip according to claim 13, wherein the Gamma voltage generating circuit comprises:

a Gamma voltage generating circuit of a red sub-pixel, wherein the Gamma voltage generating circuit of the red sub-pixel comprises a first power supply voltage terminal of the red sub-pixel and a second power supply voltage terminal of the red sub-pixel;

a Gamma voltage generating circuit of a green sub-pixel, wherein the Gamma voltage generating circuit of the green sub-pixel comprises a first power supply voltage terminal of the green sub-pixel and a second power supply voltage terminal of the green sub-pixel; and a Gamma voltage generating circuit of a blue sub-pixel, wherein the Gamma voltage generating circuit of the blue sub-pixel comprises a first power supply voltage terminal of the blue sub-pixel and a second power supply voltage terminal of the blue sub-pixel; and wherein the first power supply voltage output circuit comprises:

a first power supply voltage output circuit of the red sub-pixel, wherein an output terminal of the first power supply voltage output circuit of the red sub-pixel is electrically connected to the first power supply voltage terminal of the red sub-pixel, and an output voltage adjustment terminal of the first power supply voltage output circuit of the red sub-pixel is electrically connected to the color cast adjustment circuit;

a first power supply voltage output circuit of the green sub-pixel, wherein an output terminal of the first power supply voltage output circuit of the green sub-pixel is electrically connected to the first power supply voltage terminal of the green sub-pixel, and an output voltage adjustment terminal of the first power supply voltage output circuit of the green sub-pixel is electrically connected to the color cast adjustment circuit; and a first power supply voltage output circuit of the blue sub-pixel, wherein an output terminal of the first power supply voltage output circuit of the blue sub-pixel is electrically connected to the first power supply voltage terminal of the blue sub-pixel, and an output voltage adjustment terminal of the first power supply voltage output circuit of the blue sub-pixel is electrically connected to the color cast adjustment circuit.

17. The method for controlling the driving chip according to claim 16, wherein, after an adjustment to the first power supply voltage output by at least one of the first power supply voltage output circuits is performed according to the light-emitting duration of the light-emitting device in the display panel per unit time, under a condition of a same input signal, a brightness ratio of the red sub-pixel, the green sub-pixel and the blue sub-pixel is different from a brightness ratio of the red sub-pixel, the green sub-pixel and the blue sub-pixel before the adjustment.

* * * * *